US006447144B1

(12) United States Patent
Maxim

(10) Patent No.: US 6,447,144 B1
(45) Date of Patent: Sep. 10, 2002

(54) SPARK GENERATION LIGHTING MECHANISM FOR FLASHLIGHT AND SHOE

(76) Inventor: John G. Maxim, 863 Coventry St., Boca Raton, FL (US) 33487-3106

( * ) Notice: Subject to any disclaimer, the term of this patent is extended or adjusted under 35 U.S.C. 154(b) by 0 days.

(21) Appl. No.: 09/336,379

(22) Filed: Jun. 14, 1999

(51) Int. Cl.[7] ..... F21L 21/00
(52) U.S. Cl. ..... 362/208; 362/159; 362/103
(58) Field of Search ..... 362/157, 159, 362/171, 173, 182, 380, 202, 208; 431/273, 274, 275, 276; 36/137

(56) References Cited

U.S. PATENT DOCUMENTS 2,403,702 A * 4/1946 Adams ..... 362/159
4,280,168 A * 7/1981 Potter ..... 362/159
4,286,806 A * 9/1981 Bergstein ..... 280/816

FOREIGN PATENT DOCUMENTS

FR 735663 * 11/1932 ..... 341/274

* cited by examiner

*Primary Examiner*—Y. My Quach-Lee
(74) *Attorney, Agent, or Firm*—Oltman, Flynn & Kubler

(57) ABSTRACT

A spark generating lighting mechanism includes a quantity of spark material; a grinding wheel; a spark material retaining structure secured relative to the grinding wheel and containing the spark material; a biasing mechanism for biasing the spark material against grinding wheel; a grinding wheel rotation mechanism drivably connected to the grinding wheel; and a translucent spark shield secured relative to the grinding wheel for deflecting and containing within the mechanism burning particles of the spark material causing sparks while passing rays of light out of the mechanism. A flashlight embodiment and a lighted shoe embodiment containing the mechanism are provided.

15 Claims, 6 Drawing Sheets

SPARK GENERATION LIGHTING MECHANISM FOR FLASHLIGHT AND SHOE

BACKGROUND OF THE INVENTION

1. Field of the Invention

The present invention relates generally to the field of illumination mechanisms. More specifically the present invention relates to a spark generating lighting mechanism having a flashlight embodiment and an illuminated shoe embodiment. The lighting mechanism includes a segment of spark generating material such as flint, a grinding wheel, biasing means for biasing the spark generating material against the grinding wheel, grinding wheel rotation means, and a translucent spark shield for capturing burning particles of the material causing spark trails while passing rays of light out through the shield of the mechanism.

2. Description of the Prior Art

There have long been battery powered flashlights and shoes containing impact-activated lighting circuits with incandescent filament, neon bulb and LED light sources. A problem with batteries is that they have a limited shelf life and thus can be unreliable. Another problem is that electric circuits sometimes short and malfunction in a moist environment. Still another problem, particularly in the instance of lighted shoes, is that the circuitry can be complex and expensive.

It is thus an object of the present invention to provide a light source mechanism for flashlights, shoes and other applications which does not require electricity, and thus does not have shelf life limitations.

It is another object of the present invention to provide such a light source mechanism which cannot short and is reliable in moist environments.

It is still another object of the present invention to provide such a light source mechanism which is simple and durable.

It is finally an object of the present invention to provide such a light source mechanism which is inexpensive to manufacture.

SUMMARY OF THE INVENTION

The present invention accomplishes the above-stated objectives, as well as others, as may be determined by a fair reading and interpretation of the entire specification.

A spark generating lighting mechanism is provided, including a quantity of spark material; a grinding wheel; a spark material retaining structure secured relative to the grinding wheel and containing the spark material; a biasing mechanism for biasing the spark material against grinding wheel; a grinding wheel rotation mechanism drivably connected to the grinding wheel; and a translucent spark shield secured relative to the grinding wheel for deflecting and containing within the mechanism burning particles of the spark material causing sparks while passing rays of light out of the mechanism.

The mechanism optionally additionally includes a flashlight housing having a tubular housing side wall with a side wall forward end and a side wall rearward end, a rear wall closing the side wall rearward end, external side wall threads around the side wall forward end; an annular cap having internal threads sized to engage by screwing over the side wall threads, the cap having a central lens port; a lens sized to fit with the cap but having a diameter larger than the lens port diameter, so that the cap retains the lens across the side wall forward end; a funnel-shaped reflector having a narrower end and having wider end resting on a reflector rim within the side wall forward end, so that the lens bears against the reflector wider end and the cap compresses the perimeter of the lens and the reflector wider end against the reflector rim, holding the lens and the reflector secure relative to the flashlight housing; the reflector extending into the housing and progressively tapering to the narrower end into the housing; the spark shield secured within the narrower end of the reflector; a grinding wheel axle rotatably mounted in the housing side wall; a grinding wheel positioned immediately rearward of the spark shield and secured around the grinding wheel axle; a tubular passageway secured across the interior of the housing side wall, opening through a first side wall port and a second side wall ports, the passageway having a lateral spark light release opening into which the grinding wheel extends; a spark material guide tube extending within the passageway from the first side wall port toward the grinding wheel, the spark material guide tube containing at least one segment of spark material and a spark material biasing spring; so that operating the wheel rotation mechanism causes the grinding wheel to rotate relative to the housing and abrade the spark material, causing burning spark material particles to break away from the spark material and to strike the spark shield and cast light through the spark shield and the lens, and then to drop into the passageway through the spark light release opening for periodic removal by the user.

The reflector narrower end preferably terminates in a tubular segment containing an inwardly directed circumferential groove; where the spark shield is a dome arched toward the lens and formed of translucent material having an outwardly directed radial flange which engagingly snaps into and is retained by the circumferential groove. The mechanism preferably additionally includes at least one flywheel mounted on the grinding wheel axle.

Each of the side wall ports is preferably internally threaded, and the mechanism preferably additionally includes an externally threaded first port plug engagingly screwed into the first side wall port, and an externally threaded second port plug engagingly screwed into the second side wall port. The spark material preferably is compressed between the port plug and the grinding wheel by the spark material biasing mechanism; so that the first plug is removable from the first plug port for refilling spark material in the tube.

The wheel rotation mechanism optionally includes a grinding wheel axle spur gear mounted on the grinding wheel axle; a flywheel axle mounted adjacent and substantially parallel to the grinding wheel axle; a first flywheel axle spur gear mounted on the flywheel axle and meshing with the grinding wheel axle spur gear; a second flywheel axle spur gear mounted on the flywheel axle; a crank port in the housing side wall of the housing; a hand crank axle extending through the crank port and having a crank axle interior end within the housing and a crank axle exterior end outside the housing; a primary crank spur gear secured to the crank axle interior end, meshing with the second flywheel axle spur gear; and a hand crank mounted onto the crank axle exterior end; so that rotating the hand crank relative to the housing rotates the flywheel axle and the grinding wheel axle and the grinding wheel, thereby abrading the spark material and generating several sparks which cast light through the shield and the lens.

The wheel rotation mechanism alternatively includes a plate slot in the housing; a secondary crank spur gear mounted on the crank axle; a reciprocating lever including a lever plate having a circular plate curved edge extending into the housing through the plate slot, the curved edge having gear teeth which mesh with the secondary crank spur gear, and having a plate finger grip edge extending out of the housing; a plate pivot pin secured relative to the housing and extending through the lever plate at the center of the circular segment curved edge; a plate biasing spring secured relative to the housing and delivering spring force biasing the plate to pivot out of the housing through the plate slot; so that applying force to the finger grip edge pivots the plate into the housing, causing the gear teeth on the plate curved edge to roll along and rotate the secondary crank spur gear, which rotates the flywheel axle and in turn the grinding wheel axle, thereby rotating the grinding wheel to grind the spark material and generate sparks.

The plate biasing spring is preferably a coil spring, and the plate preferably has a spring mounting opening with a spring receiving tab, which receives one end of the plate biasing spring, and a housing projection preferably extends from a projection mount secured to the housing which receives the other end of the plate biasing spring.

The mechanism optionally additionally includes a shoe having a shoe heel; a plunger passageway secured substantially vertically to the shoe, the plunger passageway having a passageway lower end; a plunger having a plunger abrasive surface and being contained within the plunger passageway; a plunger biasing spring contained within the plunger passageway above and delivering downward force against the plunger; a spark material tube opening into the plunger passageway toward the plunger abrasive surface; a quantity of spark material having the capability of generating sparks when abraded, the spark material extending within the spark material tube; a spark material biasing spring within the spark material tube biasing the spark material toward and into contact with the plunger abrasive surface; a spark light release opening in the plunger passageway opening out of the shoe for releasing rays of light from the plunger passageway; the spark shield being secured within the spark light release opening; so that pressing the heal of the shoe against the ground causes the plunger to bear against the ground and to be driven longitudinally upward into the plunger passageway, relative to and dragging the abrasive plunger surface against the spark material segment, generating a number of sparks which radiate light through the shield until the plunger is fully depressed; and so that the biasing spring subsequently causes the plunger to advance longitudinally downward through the plunger passageway dragging the abrasive plunger surface against the spark material and again producing a number of sparks and to radiate light through the spark shield.

The spark shield is preferably bowed outwardly from the passageway adjacent to the spark material and the spark shield preferably has an inner surface which is concave for receiving spark material particles, so that spent spark material particles subsequently fall out of the spark shield and into the plunger passageway for removal by the user.

A spark generating lighting mechanism is further provided, including a flashlight housing having a tubular housing side wall with a side wall forward end and a side wall rearward end; a quantity of spark material; a grinding wheel rotatably secured within the flashlight housing; a spark material retaining structure secured relative to the grinding wheel and containing the quantity of spark material; a biasing mechanism for biasing the spark material against grinding wheel; and a grinding wheel rotation mechanism drivably connected to the grinding wheel.

The mechanism preferably additionally includes a translucent spark shield secured relative to the grinding wheel for deflecting and containing within the mechanism burning particles of the spark material causing sparks while passing rays of light out of the mechanism. The mechanism preferably further includes an annular cap having internal threads secured across the housing wall forward end and having a central lens port; and a lens sized to fit with the cap but having a diameter larger than the lens port diameter, so that the cap retains the lens across the side wall forward end. The mechanism preferably still further includes a reflector secured to the housing within the housing forward end and behind the lens. The spark shield preferably is secured within the housing forward end, forward of the grinding wheel.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 2:
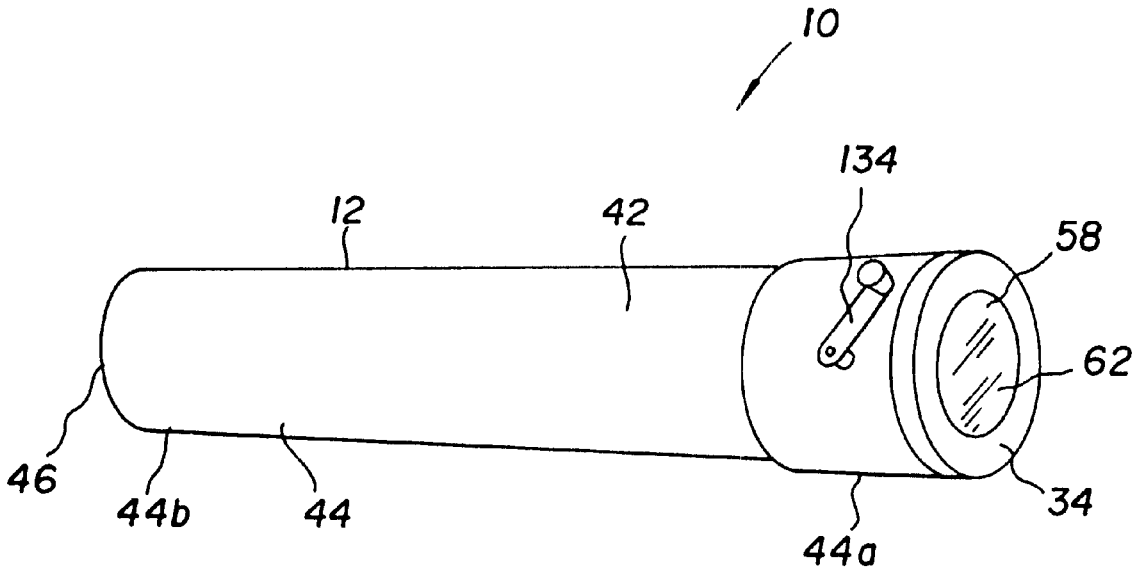
FIG. 2 is a perspective view of the flashlight embodiment of the lighting mechanism, having the hand crank grinding wheel rotation means.
Figure 1:
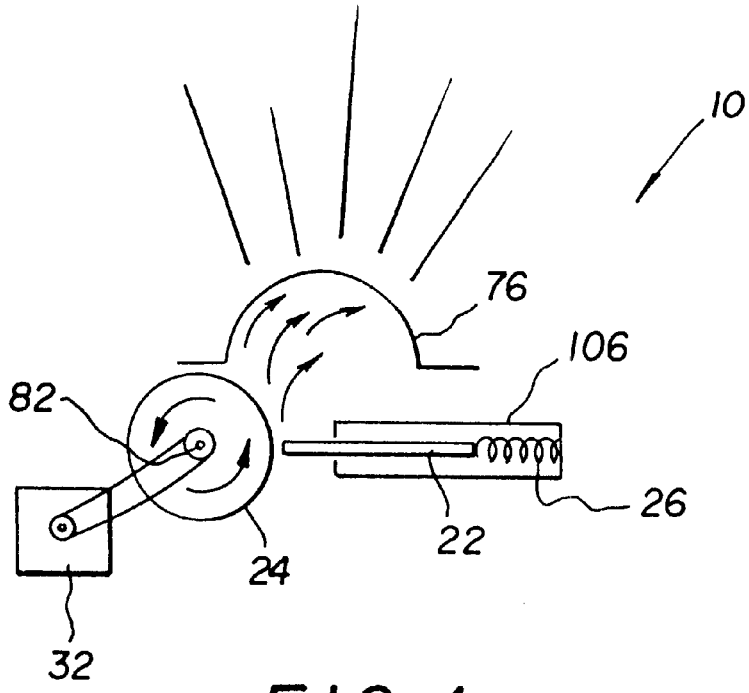
FIG. 1 is a schematic representation of the essential lighting mechanism.
Figure 3:
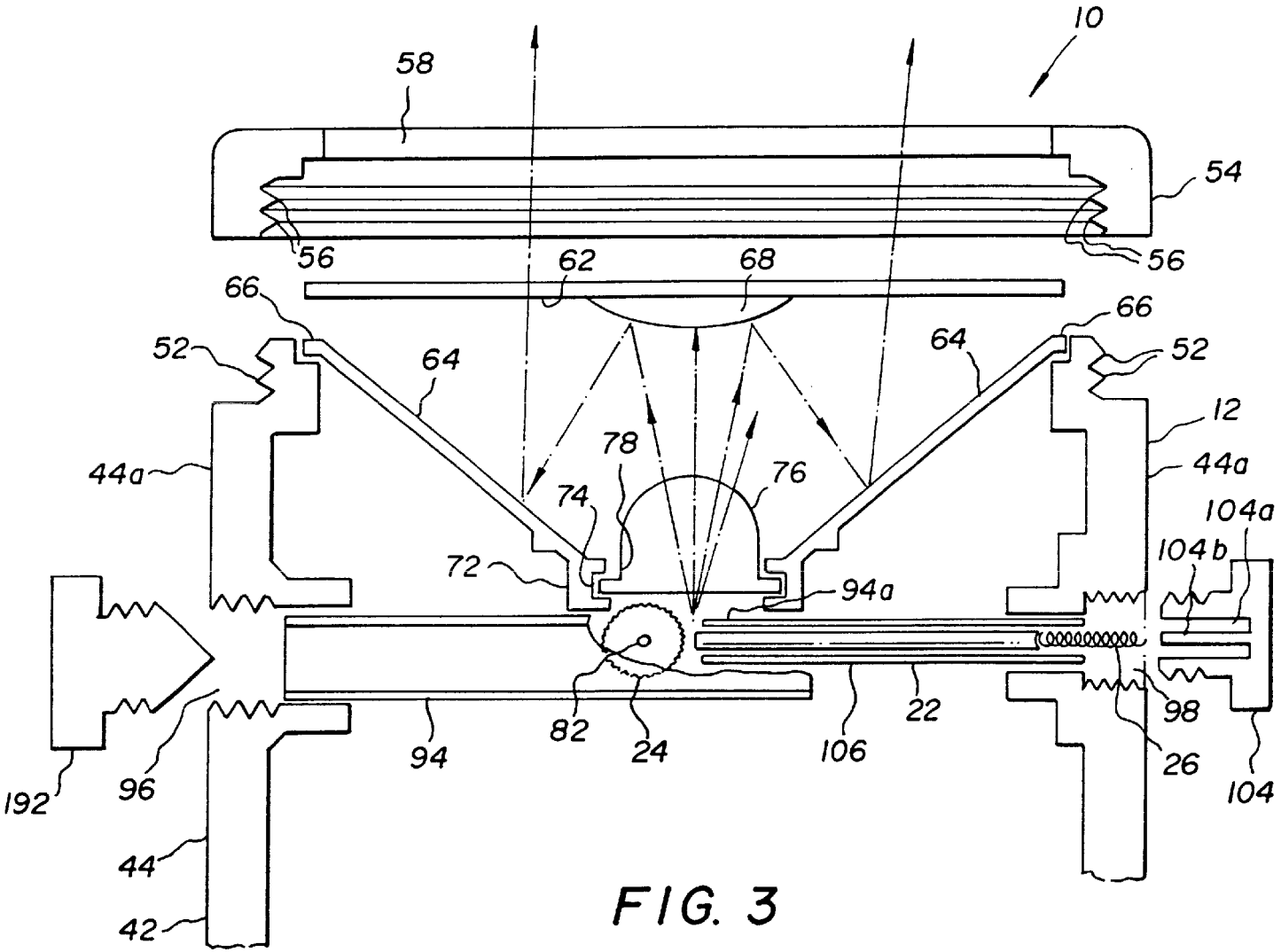
FIG. 3 is a partially exploded, cross-sectional side view of the flashlight embodiment forward end, showing the placement of the lighting mechanism elements.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–5, a spark generating lighting mechanism 10 is disclosed having a flashlight 12 embodiment and an illuminated shoe 14 embodiment. The lighting mechanism 10 includes a segment of spark material 22 such as flint or any material commonly sold for use in conventional cigarette lighters, a grinding wheel 24, biasing means such as a spark material biasing spring 26 for biasing the spark material 22 against the grinding surface of grinding wheel 24, a grinding wheel rotation mechanism 32, and a translucent spark shield in the form of a spark particle capture dome 76 for capturing burning particles of material 22 causing spark trails while passing rays of light out of the mechanism 10.

The flashlight 12 embodiment includes a conventional flashlight housing 42 having a tubular housing side wall 44 sized in diameter for convenient gripping by a user hand, the side wall 44 having a side wall forward end 44*a* and a side wall rearward end 44*b*, a rear wall 46 closing the side wall rearward end 44*b*, external side wall threads 52 around side wall forward end 44*a*, an annular cap 54 having internal threads 56 sized to engage side wall forward end 44*a* by screwing over side wall threads 52, the cap 54 having a central lens port 58, and a lens 62 sized to fit within the cap 54 but having a diameter larger than the lens port 58 diameter, so that the cap 54 retains the lens 62 closingly across side wall forward end 44*a*. A funnel-shaped reflector 64 is provided having a wider end resting on a reflector rim 66 within side wall forward end 44*a*. The lens 62 preferably bears against the reflector 64 wider end so that the secured cap 54 sealingly compresses the lens 62 perimeter and the reflector 64 wider end against reflector rim 66, holding the lens 62 and reflector 64 secure relative to the flashlight housing 42. The reflector 64 extends into housing 42 and progressively tapers to its narrower end, the narrower end terminating in a short tubular segment 72 containing an inwardly opening circumferential groove 74. The spark particle capture dome 76 formed of translucent, and preferably transparent material is provided having an outwardly directed radial flange 78 at its base which snaps into and is retained by circumferential groove 74. See FIGS. 3–5. Dome 76 rises toward lens 62. Immediately rearward of capture dome 76 is grinding wheel 24, fixedly and axially secured around a grinding wheel axle 82 rotatably mounted in bearings (not shown) fitted into opposing recesses (not shown) in housing side wall 44. Two flywheels 92 are preferably provided on the flywheel axle 114. A wheel rotation mechanism 32, preferred versions of which are described below, is secured to one or both ends of grinding wheel axle 82. A diametric, tubular passageway 94 is provided within the housing side wall 44, opening through first and second side wall ports 96 and 98, the passageway 94 having a lateral spark light release opening 94*a* into which grinding wheel 24 extends. Tubular support flanges extend from ports 96 and 98 inwardly into housing 44. Each side wall port 96 and 98 is internally threaded and an externally threaded first and second port plugs 102 and 104, respectively, are engagingly screwed into the given side wall port 96 and 98. Cap 104 preferably contains an axial spark material biasing spring receiving well which in turn contains an axial spring mounting stem. Passageway 94 contains a spark material guide tube 106 extending from the first side wall port 96 toward grinding wheel 24. The spark material guide tube 106 contains one or more segments of spark material 22 and spark material biasing spring 26 compressed between the outermost spark material 22 segment and the adjacent, first port plug 102. First side wall port 96 is opened by the user when necessary to refill spark material 22 segments. Burning flint particles striking dome 76 cast light out through dome 76 and lens 62, and then drop into passageway 94 through the lateral spark light release opening 94*a* and are periodically removed by opening first plug port 102 and orienting the flashlight housing 42 so that they fall out of passageway 94.

Figure 4:
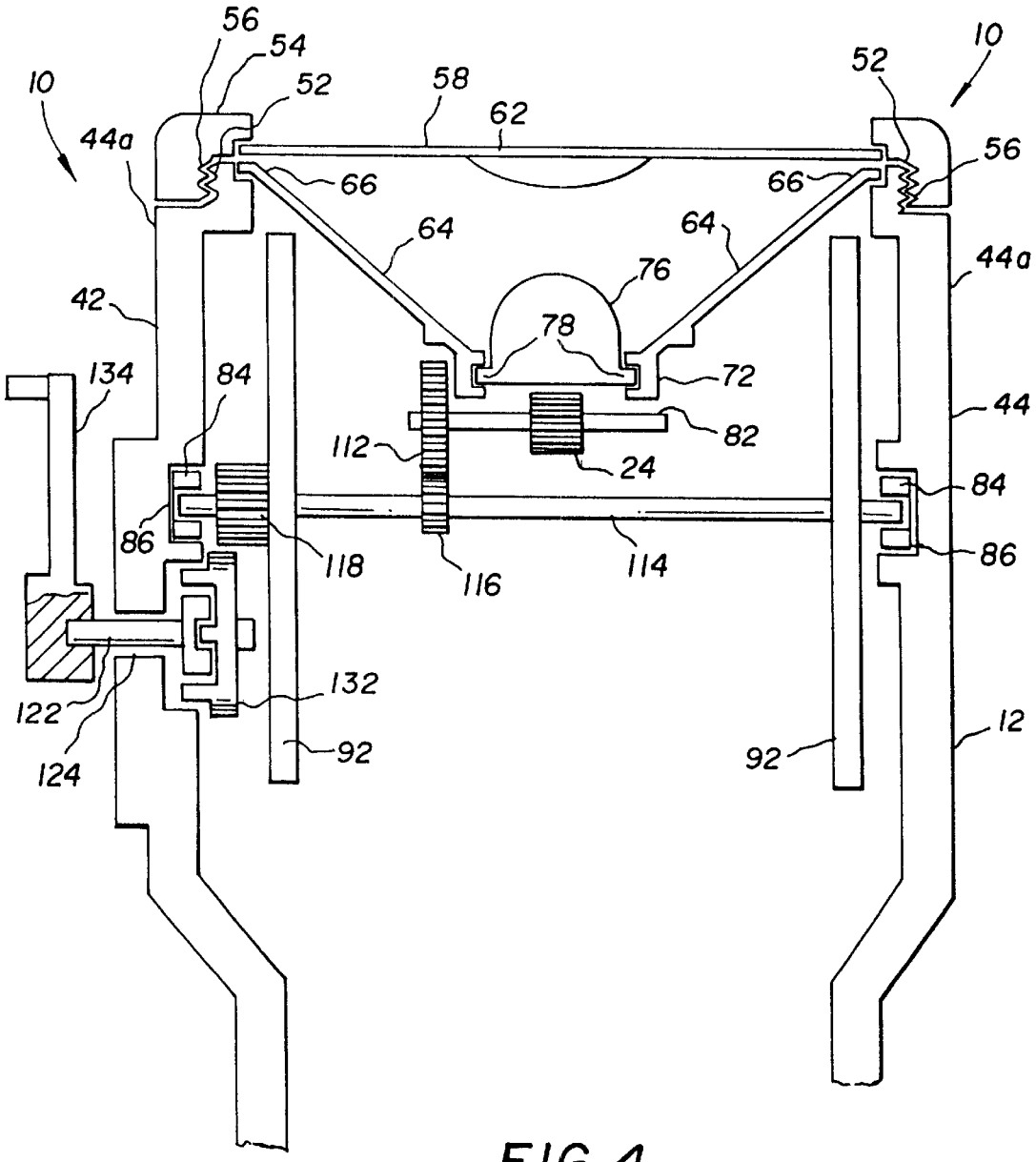
FIG. 4 is a view as in FIG. 3 showing the details of the hand crank rotation means for the grinding wheel.
Figure 4A:
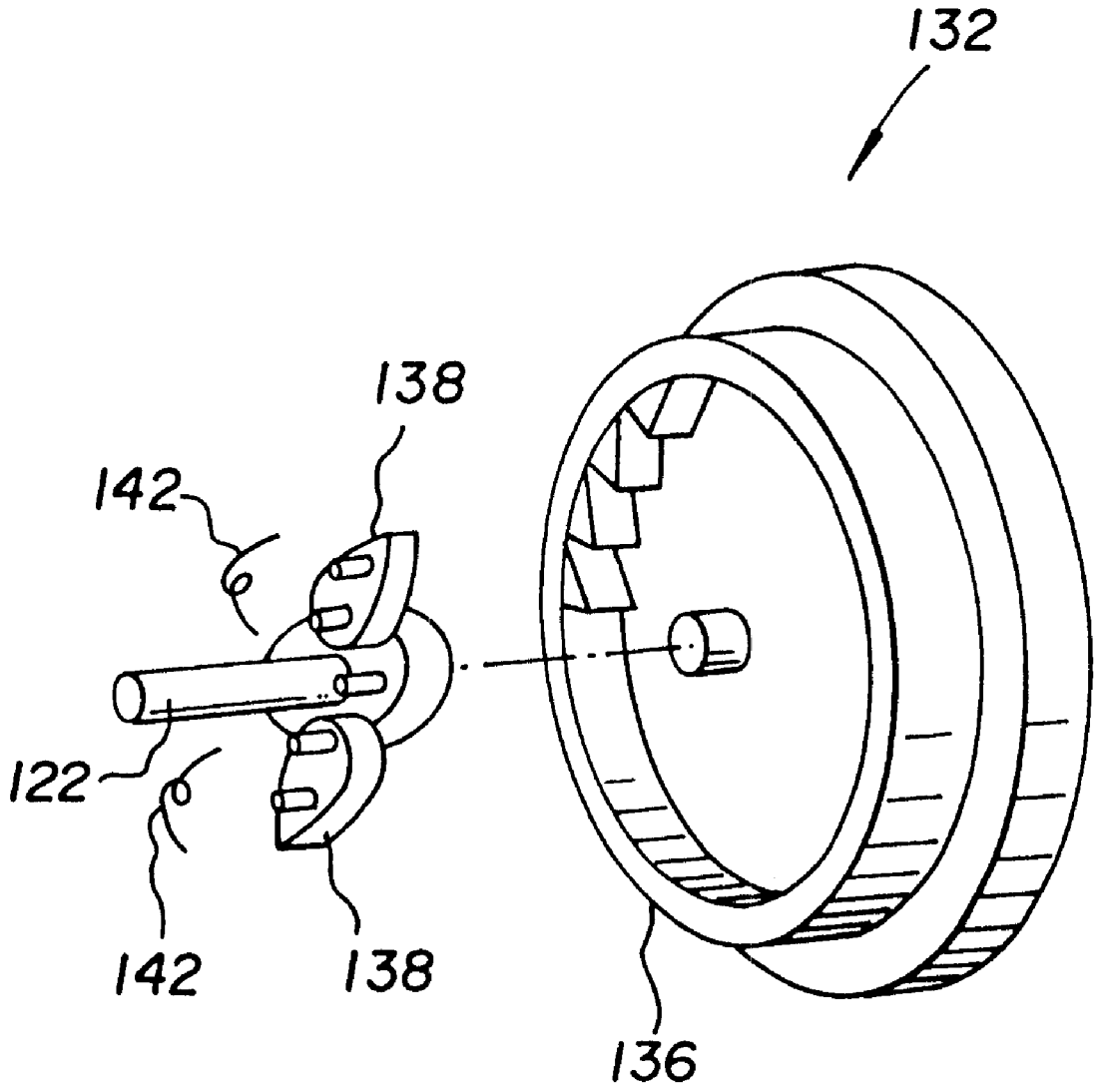
FIG. 4*a* is an exploded view of the preferred hand crank arm clutch mechanism.
Figure 5:
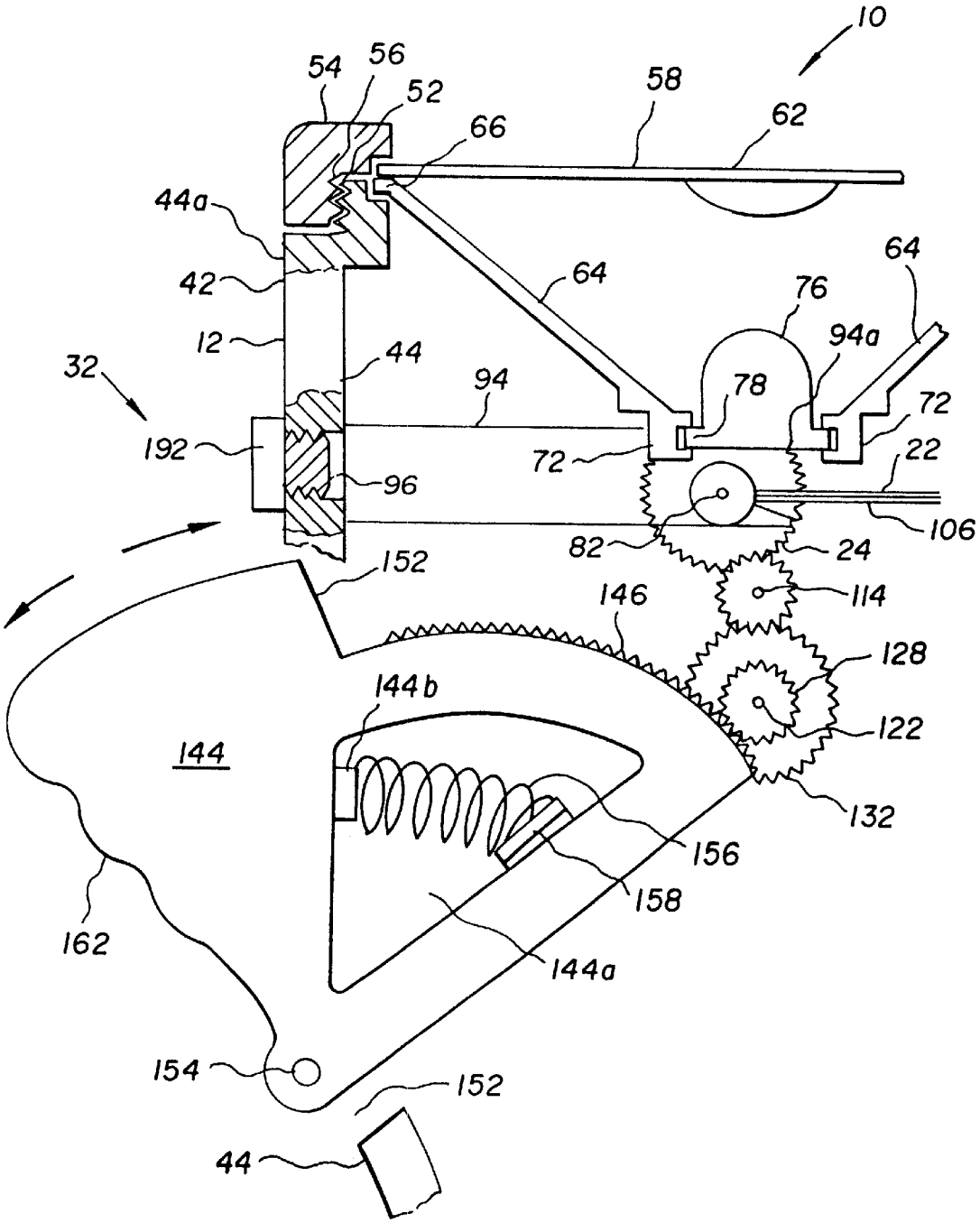
FIG. 5 is a view as in FIG. 3, showing the details of the lever plate rotation means for the grinding wheel.

One preferred wheel rotation mechanism 32 includes a grinding wheel axle spur gear 112 mounted on grinding wheel axle 82 adjacent to an end of the axle 82. See FIG. 4. A flywheel axle 114 is rotatably mounted in housing side wall 44 adjacent and parallel to the grinding wheel axle 82, in bearings 84 fitted into opposing recesses 86 in housing side wall 44. A first flywheel axle spur gear 116 is mounted on flywheel axle 114 and meshes with grinding wheel axle spur gear 112 and a second flywheel axle spur gear 118 is mounted at one flywheel axle 114 end. A hand crank axle 122 extends through a crank port 124 in housing side wall 44, and a primary crank spur gear is defined by the outer surface of a clutch 132 is secured with the crank axle 122 interior end, in meshing relation to second flywheel axle spur gear 118. A hand crank arm 134 is mounted onto the exterior end of the crank axle 122. FIG. 4*a* shows clutch elements including a clutch drum 136 having internal circumferential clutch drum pawl engaging teeth, pawls 138 for engaging the clutch drum pawl engaging teeth and a pawl biasing spring 142.

Another preferred embodiment of the wheel rotation mechanism 32 is squeezed rather than cranked by the user. See FIG. 5. The hand crank arm 134 is replaced with a reciprocating lever in the form of a contoured plate 144 having a circular segment curved edge 146 extending into housing 42 through a plate slot 152. Curved edge 146 has gear teeth which mesh with teeth of a secondary crank spur gear 128 mounted on crank axle 122 adjacent to crank clutch 132 spur gear surface. A pivot pin 154 extends through a pin port in plate 144 at a location defining the center of the curve of curved edge 146. A plate spring 156 biases plate 144 to pivot out of flashlight housing 42. Plate 144 has a spring mounting opening 144*a* with a spring receiving tab 144*b*, which receives one end of plate spring 156, and a side wall projection 158 extends from a projection mount secured to the housing side wall 44 which receives the other end of plate spring 156. A finger grip edge of the plate 144 extends out of housing 42 generally radially from pivot pin 154 and is shaped as a finger grip. Applying force to grip edge 162 pivots plate 144 into housing 42, causing the gear teeth on curved edge 146 to roll along and rotate the secondary crank spur gear 128, which through rotation of the other gears in the gear train, rotates grinding wheel 24 which grinds the spark material 22 and generates sparks.

Second Preferred Embodiment

Figure 6:
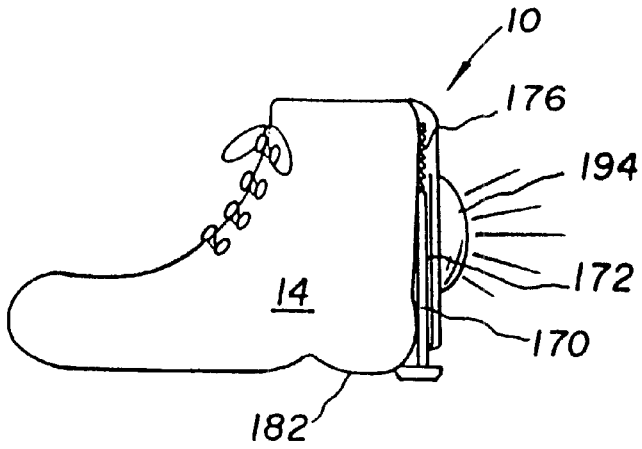
FIG. 6 is a side view of a show fitted with the second embodiment of the lighting mechanism.
Figure 7:
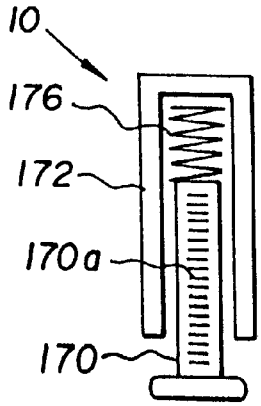
FIG. 7 is a cross-sectional front view of the shoe lighting mechanism, showing the plunger abrasive surface and biasing spring within the plunger passageway.
Figure 8:
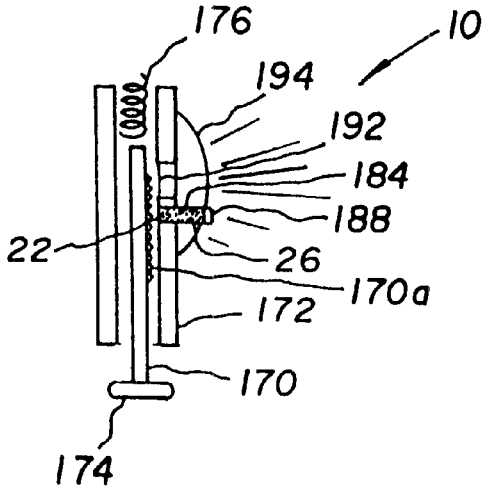
FIG. 8 is a cross-sectional side view of the shoe lighting mechanism of FIG. 7, showing the spark material retaining tube, spark material biasing spring, light passing opening and spark shield.

The shoe 14 embodiment includes a downwardly directed plunger 170 slidably contained within a plunger passageway 172. See FIGS. 6–8. Passageway 172 is secured substantially horizontally to the shoe 14, preferably behind or within the heel 182. The downward end of plunger 170 has wide foot portion 174, and a coil plunger biasing spring 176 is contained within plunger passageway 172 above plunger 170 to bias plunger 170 downwardly. A plunger stop element (not shown) is provided within plunger passageway 172 to prevent plunger 170 from extending more than a pre-set distance, perhaps a quarter of an inch, below the shoe heel 182. A spark material tube 184 extends and is affixed substantially horizontally through the rear wall of plunger passageway 172, containing a spark material 22 segment, a spark material biasing spring 26 behind the spark material 22 segment, and a tube cap 188 removably secured behind spark material biasing spring 26, such as with screw threads meshing with threads in the tube 184. The longitudinal plunger surface 170*a* of plunger 170 adjacent tube 184 is abrasive, and biasing spring 26 biases the spark material 22 segment against the abrasive plunger surface 170*a*. The rear side wall of plunger passageway 172 includes a shield receiving spark light release opening 192 and a translucent shield 194 fit into spark light release opening 192.

As a result of this construction, when a shoe 14 wearer shifts his or her weight onto the given shoe 14, the plunger 170 bears against the ground and is driven longitudinally upward into passageway 172. As plunger 170 moves within passageway 172, it also moves relative to the biased spark material 22 segment, dragging the abrasive plunger surface across the spark material 22, causing a stream of burning spark material 22 particles in the form of sparks to fly toward the shield 194, radiating light until the plunger 170 is fully depressed. Then the biasing spring 176 causes the plunger 170 to advance back downwardly through passageway 172, once again causing the plunger abrasive surface 170*a* to ride over the spark material 22 segment and again produce a stream of sparks and radiate light through shield 194. In this way, the lighting mechanism 10 causes the shoe 14 to radiate periodic bursts of light as the wearer walks, much as the electric shoe lighting circuits do today in many shoes. The shield 194 is preferably bowed outwardly beside the spark material 22 so that the shield 194 inner surface is concave and can receive the flying illuminated spark material 22 particles. The spent particles fall out of the shoe 14 through the lower end of passageway 172.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A spark generating lighting mechanism comprising:

an element mounting structure;

a grinding wheel secured relative to said mounting structure and having a spark material igniting surface;

a quantity of spark material adjacent to said grinding wheel and having a spark material first end in contact with said spark material igniting surface;

spark material retaining means secured relative to said mounting structure adjacent to said grinding wheel and containing said spark material;

biasing means bearing against said spark material second end for biasing the spark material against grinding wheel;

grinding wheel rotation means secured relative to said mounting structure and drivably connected to said grinding wheel;

and a translucent spark shield secured relative to said mounting structure and adjacent to said grinding wheel for deflecting and containing within said mechanism burning particles of said spark material causing sparks while passing rays of light;

wherein said mounting structure comprises a flashlight housing having a tubular housing side wall with a side wall forward end and a side wall rearward end, a rear wall closing said side wall rearward end, external side wall threads around said side wall forward end;

an annular cap having internal threads sized to engage by screwing over said side wall threads, the cap having a central lens port with a lens port diameter;

a lens sized to fit with the cap but having a diameter larger than said lens port diameter, such that said cap retains said lens across said side wall forward end;

funnel-shaped reflector having a narrower end and having wider end terminating with a reflector rim within said side wall forward end, such that said lens bears against said reflector wider end and said cap compresses the perimeter of said lens against said reflector rim of said reflector wider end, holding said lens and said reflector secure relative to said flashlight housing;

said reflector extending into said housing and progressively tapering to said narrower end into said housing;

said spark shield secured within the narrower end of said reflector;

a grinding wheel axle rotatably mounted in said housing side wall;

wherein said grinding wheel is positioned immediately rearward of said spark shield and secured around said grinding wheel axle;

a tubular passageway secured across the interior of said housing side wall, opening through a first side wall port and a second side wall port, said passageway having a lateral spark light release opening into which said grinding wheel extends;

wherein the spark material retaining means comprises a spark material guide tube extending within said passageway from said first side wall port toward said grinding wheel, said spark material guide tube containing at least one segment of spark material and wherein said biasing means comprises a spark material biasing spring;

such that operating said wheel rotation means causes said grinding wheel to rotate relative to said housing and abrade said spark material, causing burning spark material particles to break away from said spark material and to strike said spark shield and cast light through said spark shield and said lens, and then to drop into said passageway through said spark light release opening for periodic removal by the user.

2. The mechanism of claim 1, wherein said reflector narrower end terminates in a tubular segment containing an inwardly directed circumferential groove; wherein said spark shield is a dome arched toward said lens and formed of translucent material having an outwardly directed radial flange which engagingly snaps into and is retained by said circumferential groove.

3. The mechanism of claim 1, additionally comprising at least one flywheel mounted on a flywheel axle.

4. The mechanism of claim 1, wherein each said side wall port is internally threaded, additionally comprising:

an externally threaded first port plug engagingly screwed into said first side wall port, and an externally threaded second port plug engagingly screwed into said second side wall port.

5. The mechanism of claim 4, wherein said spark material is compressed between said first port plug and said grinding wheel by said spark material biasing means; such that said first plug is removable from said first side wall port for refilling spark material in said tube.

6. The mechanism of claim 1, wherein said wheel rotation means comprises:

a grinding wheel axle spur gear mounted on said grinding wheel axle;

a flywheel axle mounted adjacent and substantially parallel to said grinding wheel axle;

a first flywheel axle spur gear mounted on said flywheel axle and meshing with said grinding wheel axle spur gear;

a second flywheel axle spur gear mounted on said flywheel axle;

a crank port in said housing side wall of said housing;

a hand crank axle extending through said crank port and having a crank axle interior end within said housing and a crank axle exterior end outside said housing;

a primary crank spur gear secured to said crank axle interior end, meshing with said second flywheel axle spur gear;

and a hand crank mounted onto said crank axle exterior end;

such that rotating said hand crank relative to said housing rotates said flywheel axle and said grinding wheel axle and said grinding wheel, thereby abrading said spark material and generating a plurality of sparks which cast light through said shield and said lens.

7. The mechanism of claim 1, wherein said wheel rotation means comprises:

a plate slot in said housing;

a crank spur gear mounted on a crank axle;

a reciprocating lever operatively connected to said crank axle including a reciprocating lever in the form of a contoured plate having a circular segment curved edge extending into said housing through said plate slot, wherein said curved edge comprises gear teeth which mesh with teeth of said crank spur gear, and having a plate finger grip edge extending out of said housing;

a plate pivot pin secured relative to said housing and extending through said lever plate at the center of said circular segment curved edge;

a plate biasing spring secured relative to said housing and delivering spring force biasing said plate to pivot out of said housing through said plate slot;

such that applying force to said finger grip edge pivots said plate into said housing, causing the gear teeth on said plate curved edge to roll along and rotate said crank spur gear, which rotates a flywheel axle spur gear mounted on a flywheel axle and connected to a grinding wheel axle spur gear mounted on said grinding wheel axle, thereby rotating said grinding wheel to grind said spark material and generate sparks.

8. The mechanism of claim 7, wherein said plate biasing spring is a coil spring, and wherein said plate has a spring mounting opening with a spring receiving tab, which receives one end of said plate biasing spring, and wherein a housing projection extends from a projection mount secured to said housing which receives the other end of said plate biasing spring.

9. A spark generating lighting mechanism comprising:

an element mounting structure;

a plunger secured relative to said mounting structure and having a spark material igniting surface;

a quality of spark material adjacent to said spark material igniting surface and having a spark material first end in contact with said spark material igniting surface;

spark material retaining means secured relative to said mounting structure adjacent to said spark material igniting surface and containing said spark material;

biasing means bearing against a spark material second end for biasing the spark material against said spark material igniting surface;

and a translucent spark shield secured relative to said mounting structure and adjacent to said spark material igniting surface for deflecting and containing within said mounting structure burning particles of said spark material causing sparks while passing rays of light;

said mounting structure comprised of a shoe having a shoe heel;

a plunger passageway secured substantially vertically to said shoe, said plunger passageway having a passageway lower end; wherein said spark material igniting surface is contained within said plunger passageway;

a plunger biasing spring contained within said plunger passageway above and delivering downward force against said plunger;

wherein said spark material retaining means comprises a spark material tube opening into said plunger passageway toward said spark material igniting surface and wherein said spark material extends within said spark material tube;

wherein said biasing means comprises a spark material biasing spring within said spark material tube biasing said spark material toward and into contact with said spark material igniting surface;

a spark light release opening in said plunger passageway opening out of said shoe for releasing rays of light from said plunger passageway;

said shield being secured within said spark light release opening;

such that pressing the heel of said shoe against the ground causes said plunger to bear against the ground and to be driven longitudinally upward into said plunger passageway, relative to and dragging said spark material igniting surface against said spark material, generating a plurality of sparks which radiate light through said shield until said plunger is fully depressed; and such that said plunger biasing spring subsequently causes said plunger to advance longitudinally downward through said plunger passageway dragging said spark material igniting surface against said spark material and again producing a plurality of sparks and to radiate light through said spark shield.

10. The mechanism of claim 9, wherein said spark shield is bowed outwardly from said passageway adjacent to said spark material and said spark shield has an inner surface which is concave for receiving spark material particles, such that spent spark material particles subsequently fall out of said spark shield and into said plunger passageway for removal by the user.

11. A spark generating lighting mechanism comprising:

a flashlight housing having a tubular housing side wall with a side wall forward end with side wall threads and a side wall rearward end;

a quantity of spark material;

a grinding wheel rotatably secured within said flashlight housing;

spark material retaining means secured relative to said grinding wheel and containing said quantity of spark material;

biasing means for biasing the spark material against grinding wheel;

grinding wheel rotation means drivably connected to said grinding wheel;

a translucent spark shield secured relative to said grinding wheel such that said spark shield deflects and containing within said mechanism burning particles of said spark material causing sparks while passing rays of light;

an annular cap having internal threads sized to engage by screwing over said side wall threads, the cap having a central lens port with a lens port diameter;

and a lens sized to fit with the cap but having a diameter larger than said lens port diameter, such that said cap retains said lens across said side wall forward end.

12. The mechanism of claim 11, additionally comprising reflector means secured to said housing within said side wall forward end and behind said lens.

13. The mechanism of claim 11, wherein said spark shield is secured within said side wall forward end, forward of said grinding wheel.

14. A spark generating lighting mechanism comprising:

an element mounting structure;

a grinding wheel secured relative to said mounting structure and having a spark material igniting surface;

a quantity of spark material adjacent to said grinding wheel and having a spark material first end in contact with said spark material igniting surface;

spark material retaining means secured relative to said mounting structure adjacent to said grinding wheel and containing said spark material;

biasing means bearing against a spark material second end for biasing the spark material against grinding wheel;

grinding wheel rotation means secured relative to said mounting structure and drivably connected to said grinding wheel;

funnel-shaped reflector positioned forwardly of said grinding wheel, said reflector having a reflector narrower end and having a reflector wider end extending forwardly of said reflector narrower end and having a reflector opening at said reflector narrower end, said reflector wider and progressively tapering rearwardly to said reflector opening;

and a translucent spark shield secured contiguously with said reflector and extending across said reflector opening and adjacent to said grinding wheel for deflecting and containing within said mechanism burning particles of said spark material causing sparks while passing rays of light and prevents said burning particles from striking the reflector;

a lens secured forwardly of said translucent spark shield.

15. The mechanism of claim 14, wherein said spark shield is a dome arched toward said lens.

* * * * *